United States Patent [19]

Plitt et al.

[11] Patent Number: 4,875,882

[45] Date of Patent: Oct. 24, 1989

[54] SPLASH GUARD FOR OUTBOARD MOTOR

[76] Inventors: Cheryl A. Plitt, 3075 Hwy. F, Redgranite, Wis. 54970; James C. Dutcher, 5085 Burr Oak Rd., Oshkosh, Wis. 54904

[21] Appl. No.: 238,753

[22] Filed: Aug. 30, 1988

[51] Int. Cl.[4] ..... B63H 1/18

[52] U.S. Cl. ..... 440/66; 114/274

[58] Field of Search ..... 440/49, 51, 66, 71, 440/78, 900; 114/145 A, 271, 274

[56] References Cited

U.S. PATENT DOCUMENTS

| | | | |
|---|---|---|---|
| 2,442,728 | 6/1948 | Kiekhaefer | 440/78 |
| 2,555,548 | 6/1951 | Kiekhaefer | 440/66 |
| 2,564,903 | 8/1951 | Irgens | 440/78 |
| 2,787,974 | 4/1957 | Johnson | 114/145 A |
| 2,860,594 | 11/1958 | Kiekhaefer | 440/66 |
| 2,912,955 | 11/1959 | Leipert | 440/66 |
| 3,211,119 | 10/1965 | Kiekhaefer | 114/274 |
| 4,026,231 | 5/1977 | Fedorko | 114/145 A |
| 4,487,152 | 12/1984 | Larson | 440/66 |
| 4,657,513 | 4/1987 | Baker | 440/66 |
| 4,708,672 | 11/1987 | Bentz et al. | 440/66 |
| 4,744,779 | 5/1988 | Koehler | 440/66 |

FOREIGN PATENT DOCUMENTS

| | | | |
|---|---|---|---|
| 716879 | 10/1954 | United Kingdom | 440/66 |

OTHER PUBLICATIONS

A page from 1960 Quick Silver Catalog published by the Mercury Marine Division of Brunswick Corporation.

pp. 08941 and 08943 from the 1974 service manual published by Mercury Marine Division of Brunswick Corporation.

An advertisement appearing at p. 72 of a magazine entitled Western Boatman, vol. 5, No. 3, published May/Jun. 1987.

Advertisement, p. 87 from a magazine entitled Western Boatman, vol. 4, No. 1, published Jan./Feb. 1986.

*Primary Examiner*—Joseph F. Peters, Jr.
*Assistant Examiner*—Jesus D. Sotelo

[57] ABSTRACT

A water deflector or splash guard for diverting water away from the powerhead and bracket assemblies of an outboard motor during operation of a boat. The splash guard includes a flat planar head portion extending forwardly of the gearcase and a body portion extending rearwardly of the head portion comprising a pair of spaced apart fin members disposed on opposite sides of the gearcase. In one form, the splash guard is substantially U-shaped and is mounted between the anti-ventilation plate and spray plate of an outboard motor exteriorly of the outer surface of the gearcase. In another form, the splash guard includes an integral tail section and is mounted by being sandwiched between the gearcase and drive shaft housing.

19 Claims, 2 Drawing Sheets

SPLASH GUARD FOR OUTBOARD MOTOR

BACKGROUND OF THE INVENTION

The present invention relates to marine propulsion drives, and more particularly to a water deflector or splash guard for an outboard motor.

During operation of some outboard motors, water can on occasion splash, spray and flow onto the engine cowl, trim bracket assembly and motor mounting assemlby of the outboard motor and create unsightly water spray. Besides the undesirable effect of water splashing and spraying at the exterior of the engine such water action increases the possiblilty of corrosion in salt water applications. Such undesirable water action is particularly demonstrated with conventional boats having deep V or notched hulls since these types of boats tend to demonstrate undesirable water at their stern during forward operation. Therefore, it would be desirable to provide a device which would tend to divert water away from the outboard motor, the motor mounting area, and the boat transom during forward operation of a boat.

Various types of splash guards have been proposed and are known in the art. For example, U.S. Pat. Nos. 2,860,594 and 2,442,728 show outboard motors with splash guards integrally cast on the drive shaft housing, and U.S. Pat. No. 4,657,513 shows a water deflector mounted on the lower end of a transom bracket for an outboard motor. There remains a need, however, for an improved splash guard that not only is effective to reduce water splashing and spraying but also may be easily mounted on an outboard motor in a location and with a design that does not inhibit motor performance.

SUMMARY OF THE INVENTION

A water diverter or splash guard for an outboard motor. The splash guard diverts water away from the motor itself as well as away from the boat transom and motor mounting assembly during forward operation of the boat.

The splash guard includes a heat portion projecting from the front of the gearcase and a body portion extending rearwardly of the head portion which includes a pair of spaced fin members disposed on opposite sides of the gearcase, and mounting means for mounting the water deflector on the gearcase. The head portion and fin members project from the gearcase to divert and knock down water during boat operation.

The splash guard is preferably flat and substantially planar in shape with the fin members integral with the head portion and disposed adjacent opposite sides of the gearcase of the outboard motor. In one form, the leading edge of the head portion is arcuate shaped and at least a portion of the outer edge of one fin member is substantially parallel to the outer edge of the other fin member. In this form, each of the outer edges of the fin members is convexly curved in the plane of the water deflector and convexly curves all the way to the leading edge of the head portion without any straight sections therebetween and merging into the leading edge along the continuous unbroken curve of positive radius of curvature. In this form, the splash guard is substantially U-shaped and is mounted exteriorly of the gearcase between the anti-ventilation plate (commonly referred to in the industry as a cavitation plate) above the propeller and spray plate spaced above the anti-ventilation plate. The mounting means includes at least one integral tab member extending inwardly from the inner edge of the fin members, and includes an opening extending therethrough for receiving a securing member such as a bolt.

In another form, the splash guard includes a tail portion integral with the body portion and extending rearwardly thereof. In this form, the water deflector is mounted or sandwiched between the gearcase and drive shaft housings and thus the body portion defines a first opening formed therethrough through which the drive shaft extends and a second opening formed therethrough rearwardly of the first opening through which engine exhaust passes. A cross member extending laterally between the inner edges of The fin members separates the first and second openings and functions to seal the drive shaft and water pump from the engine exhaust. A third opening disposed substantially in the tail portion is positioned to coincide with a cooling water exit passage. In this form, the splash guard includes a plurality of openings extending therethrough which cooperate with dowels extending between the drive shaft housing and gearcase to properly align and locate the splash guard. Further, a plurality of tab members with openings therethrough extend inwardly into the first and second openings for mounting or securing the splash guard in place.

The present invention thus provides a splash guard which diverts water away from the outboard motor, boat transom and transom mounting area during forward operation of the boat. The splash guard reduces the splashing, spraying and flowing of water onto the outboard motor, boat transom and motor mounting area. It is especially useful on conventional boats with deep V or notched hulls since these types of boats tend to demonstrate undesirable water at their stern during forward operation. Also, by diminishing the quantity of attacking water, the splash guard may be particularly advantageous for reducing corrosion in salt water applications.

Other features and advantages of the invention will become apparent to those skilled in the art upon reviewing the detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENTS

Figure 1:
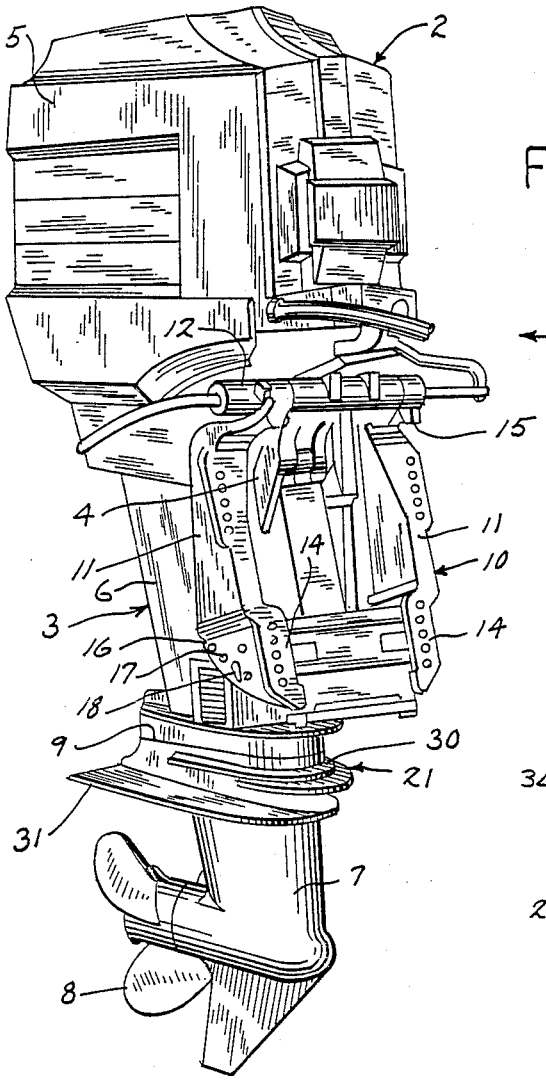
FIG. 1 is a perspective view of an outboard motor incorporating a first embodiment of a splash guard constructed in accordance with the principles of the present invention.

Referring now to the drawings, FIG. 1 illustrates a marine propulsion drive in the form of an outboard motor 1 having a propulsion assembly including an upper unit or powerhead 2, a lower unit 3 and a swivel bracket 4. Upper unit 2 includes a cover or cowl 5 defining an engine compartment for housing an internal combustion engine (not shown).

The lower unit 3 is rigidly mounted to the bottom of the powerhead or upper unit 2 and includes a drive shaft housing 6 and a gearcase 7. The gearcase 7 is normally submerged in water and supports a rotatable propeller shaft carrying a propeller 8. Gearcase 7 houses a suitable reversing transmission which drivingly connects propeller 8 to a drive shaft extending through the drive shaft housing 6 which drivingly interconnects the engine and propeller 8.

Lower unit 3 is connected to swivel bracket 4 for swivel or turning movement about a vertical axis and in a horizontal plane to provide steering control of motor 1. Gearcase 7 is removably separable from the bottom of drive shaft housing 6 along a parting line 9 by means of securing bolts 19 and dowel pins 20 (see FIG. 6) which function to properly align the gearcase 7 to housing 6 during assembly.

Outboard motor 1 is supported on a transom or other supporting member of a boat hull by a transom bracket 10 on which the swivel bracket 4 is mounted. Outboard motor 1 including swivel bracket 4 is connected to transom bracket 10 for pivotal or tilting movement about a horizontal transverse axis and in a vertical plane between an operating position wherein gearcase 7 and propeller 8 are fully submerged in water, and a tilted or non-operating position wherein gearcase 7 and propeller 8 are raised from the water, as for trailering.

Transom bracket 10 includes two spaced-apart clamp members or mounting members 11 for removably mounting outboard motor 1 on the boat transom. Clamp members 11 are interconnected by a pivot pin or tilt shaft 12 which extends substantially horizontally between the upper ends of clamp members 11. Each clamp 11 has an upper body portion with an integral outside leg 14 extending downwardly therefrom and defining a transom receiving opening 15. Outside leg 14 has an inner bearing surface for bearing engagement against the outside surface of the transom when clamp members 11 are clamped together thereon. Each outside leg 14 also has a rearwardly extending arm 16 thereon with spaced holes 17 therein. A tilt pin 18 is carried through the proper holes 17 resulting in proper trim for motor 1 during operation. A similar arrangement is also present in power trim mounts except that pin 18 is replaced with a selectively movable lock mechanism. Transom receiving opening 15 may be of any desired width sufficient to enable the engine to be readily installed over transoms of any thickness within a desired range.

Figure 2:
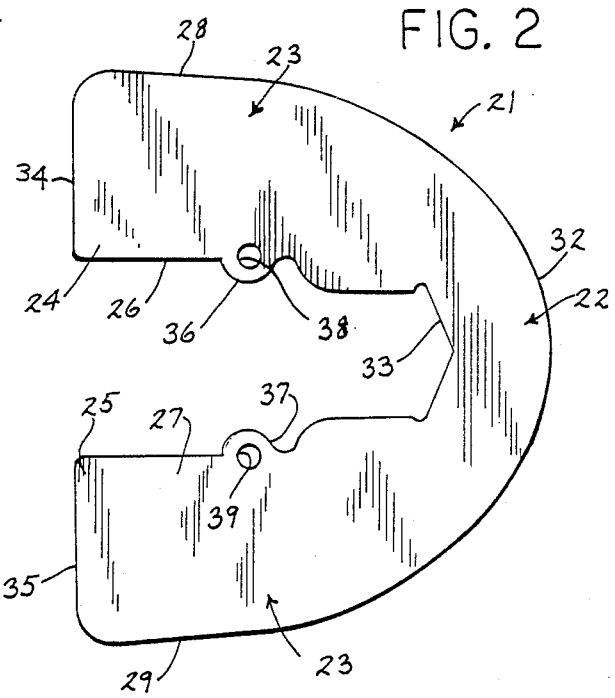
FIG. 2 is a top plan view of the splash guard of FIG. 1.
Figure 3:
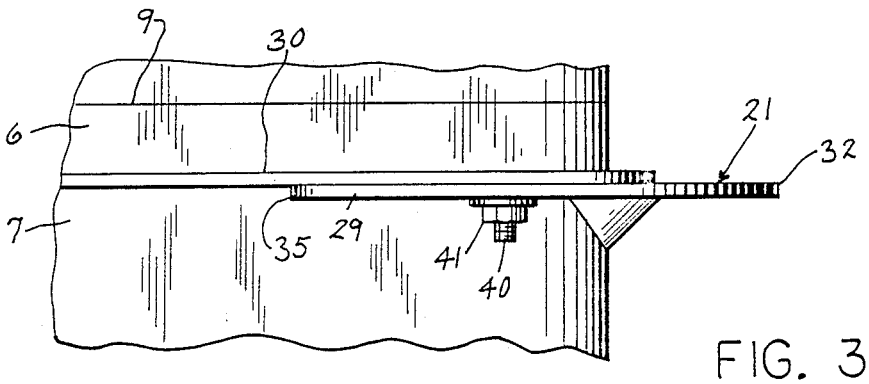
FIG. 3 is a fragmentary side view in elevation of the splash guard of FIG. 1.

A water deflector or splash guard 21 is also illustrated in FIG. 1, and in more detail in FIGS. 2–3, for diverting water away from the powerhead and transom bracket assemblies during forward operation of the boat. More particularly, splash guard 21 includes a flat, substantially planar, U-shaped water deflector member that is mounted exteriorly on the outer surface of gearcase 7. Preferably, splash guard 21 is composed of 0.125 inch thick flat plate aluminum. As shown best in FIG. 2, the deflector member includes a head portion 22 and a body portion 23 which includes a pair of rearwardly extending spaced fin members 24, 25 defining a central opening for receiving gearcase 7 of lower unit 3 of motor 1. As shown best in FIG. 2, fin members 24, 25 are integral with head portion 22 and are disposed adjacent opposite sides of gearcase 7. Each fin member 24, 25 includes an inner edge 26, 27 respectively disposed adjacent and in engagement with the outside surface of gearcase 7, and an outer edge 28, 29 respectively spaced outwardly from the side of gearcase 7. As shown best in FIG. 2, at least a portion of the outer edges 28, 29 of fin members 24, 25 are disposed substantially parallel to one another. Preferably, outer edges 28, 29 project approximately 1 and ⅝ inches beyond the outer surface of gearcase 7 such that outer edges 28, 29 extend beyond the outer edge of a spray plate 30 formed integrally at the upper end of gearcase 7, and also project beyond the outer edges of an anti-ventilation plate 31 disposed beneath spray plate 30.

The head portion 22 of spash guard 21 includes a leading edge 32 spaced forwardly of the outer surface of gearcase 7 and a trailing edge 33 disposed adjacent to and in engagement with the outer surface of gearcase 7. As shown best in FIG. 1, head portion 32 projects forwardly of gearcase 7 substantially beyond the leading edges of spray plate 30 and anti-ventilation plate 31. To minimize drag, the outer edges 28, 29 of fin members 24, 25 are convexly curved in the plane of splash guard 21 and convexly curve all the way to the leading edge 32 of head portion 22 without any straight sections therebetween and merging into the leading edge 32 along a continuous unbroken curve of positive radius of curvature. Thus, in one application, leading edge 32 may be formed with a radius of curvature of about 3.6 inches merging into an intermediate portion having about a 6 inch radius of curvature with the most rearwardly portions of outer edges 28, 29 forming an angle of approximately 86° with the trailing ends 34, 35 of fin members 24, 25 respectively, to form the substantially parallel outer edges for fin members 24, 25.

Trailing edge 33 of head portion 22 as well as inner edges 26, 27 of fin members 24, 25 substantially conform to the shape of the outer surface of gearcase 7 with the exception that each fin member 24, 25 includes a tab member 36, 37 respectively extending inwardly from its inner edge 26, 27 which functions to mount splash guard 21 on gearcase 7. More specifically, each tab member 36, 37 includes an opening 38, 39 formed therethrough for receiving a securing bolt or stud 40 therethrough. Bolts or studs 40 extend downwardly through openings 38, 39 and are secured by nuts 41 to hold splash guard 21 on the exterior of gearcase 7 between spray plate 30 and anti-ventilation plate 31. Thus, splash guard 21 may be easily assembled or removed from gearcase 7.

Figure 4:
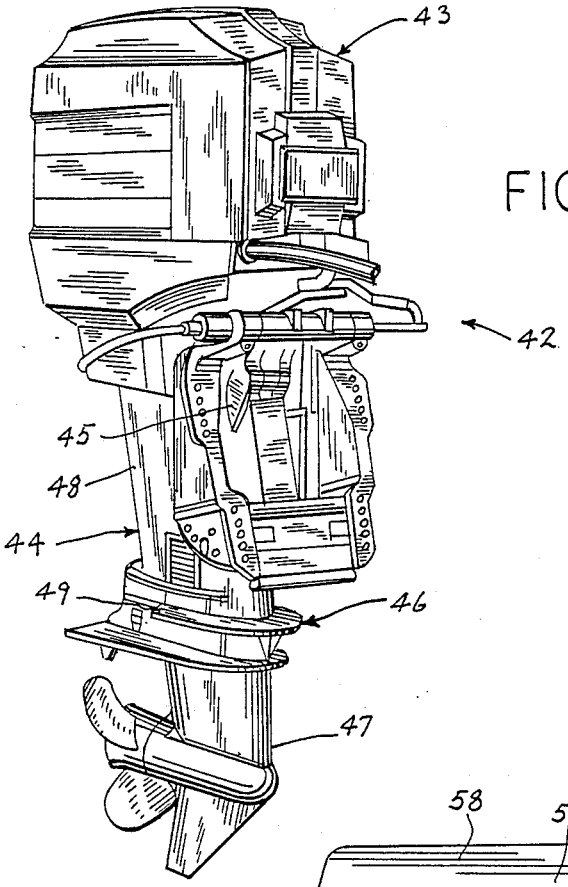
FIG. 4 is a perspective view of an outboard motor incorporating a second embodiment of the splash guard of the present invention.
Figure 5:
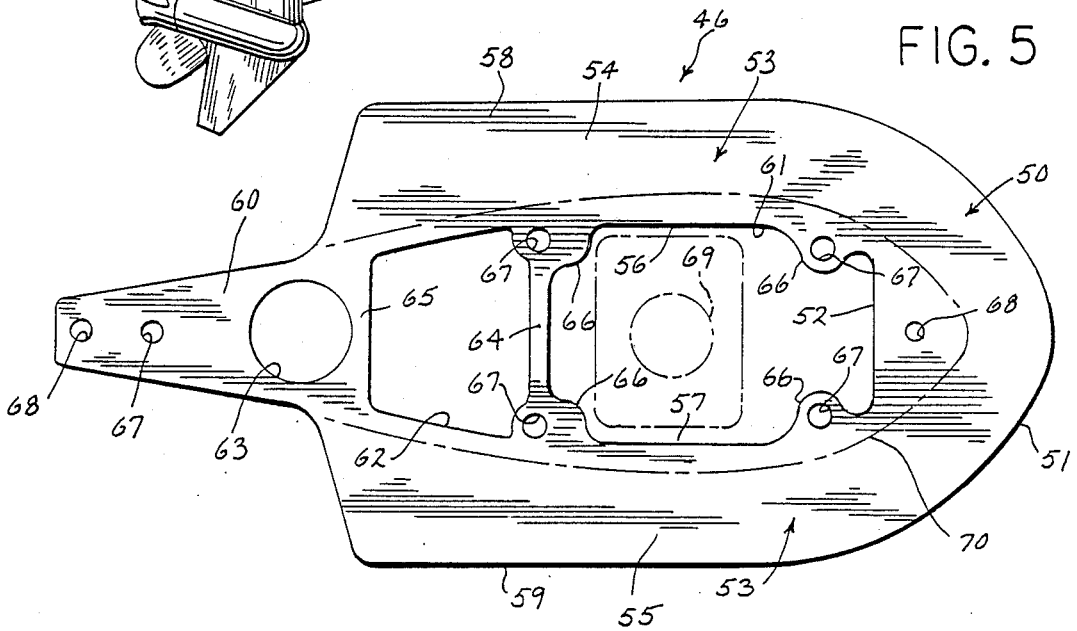
FIG. 5 is a top plan view of the splash guard of FIG. 4.
Figure 6:
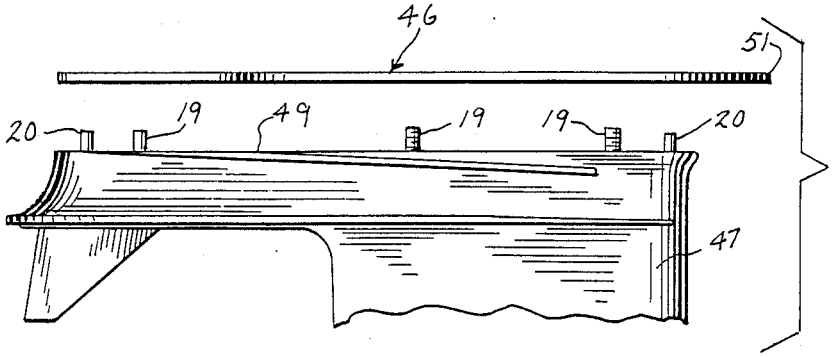
FIG. 6 is a fragmentary exploded side view in elevation of the splash guard of FIG. 4.

Referring now to FIGS. 4–6, there is illustrated a second embodiment of the splash guard or water deflector of the present invention. FIG. 4 illustrates the marine propulsion drive in the form of an outboard motor 42 having a propulsion assembly including an upper unit or powerhead 43, a lower unit 44 and a swivel bracket 45, substantially as illustrated with respect to the first embodiment hereinbefore described.

Referring now to FIG. 5, a water deflector splash guard 46 is illustrated for diverting water away from the powerhead and transom bracket assemblies during forward operation of a boat. More particularly, splash guard 46 includes a flat, substantially planar member that is mounted by being sandwiched between the top of gearcase 47 and the bottom of drive shaft housing 48 along parting line 49. As shown best in FIG. 5, the planar member includes a head portion 50 having an arcuate shaped leading edge 51 spaced forwardly of gearcase 47 and a straight, laterally extending trailing edge 52 disposed adjacent the front edge of gearcase 47. Splash guard 46 also includes an integral body portion 53 extending rearwardly from head portion 50 which includes a pair of spaced fin members 54, 55 disposed on opposite sides of gearcase 47 and projecting therefrom. Each fin member 54, 55 includes an inner edge 56, 57 and an outer edge 58, 59 respectively. Outer edges 58, 59 are disposed substantially parallel to one another. Splash guard 46 further includes an integral tail portion 60 connected to the rearward ends of fin members 54, 55 and extending rearwardly thereof to substantially match the shape of lower unit 44 of outboard motor 42.

Inner edges 56, 57 of fin members 54, 55 define a first opening 61 which coincides with the drive shaft opening and water pump in drive shaft housing 48 for accommodating the drive shaft (shown in phantom lines at 69 in FIG. 5) of motor 42. A second opening 62 is formed through splash guard 46 rearwardly of opening 61 which coincides with an engine exhaust passage through which engine exhaust may exit motor 42. Finally, a third opening 63 is formed rearwardly of opening 62 and substantially in tail portion 60 which coincides with an engine cooling water passage to permit cooling water to pass from motor 42. A cross member 64 extends laterally between inner edges 56, 57 and interconnects fin members 54, 55 between openings 61 and 62. Cross member 64 functions to prevent commingling of exhaust gases with the drive shaft and water pump opening when splash guard 46 is sandwiched between gearcase 47 and housing 48. Another cross mnember 65 extends between fin members 54, 55 rearwardly of cross member 64 and functions to prevent commingling of exhaust gases with cooling water.

In order to mount and secure splash guard 46 between the top of gearcase 47 and the bottom of drive shaft housing 48, splash guard 47 includes a plurality of tab members 66 projecting inwardly from inner edges 56, 57 of fin members 54, 55, having openings 67 formed therethrough together with two smaller diameter openings 68, one of which is formed through tail portion 60 and one through head portion 50. Openings 68 function to receive dowel pins 20 (FIG. 6) for properly positioning and locating splash guard 46, and openings 67 and tab member 66 function to receive bolt members 19 therethrough for securing splash guard 46 in place when gearcase 7 is securely fastened to the bottom of drive shaft housing 48. The outline of drive shaft housing 48 is shown at 70 in FIG. 5.

A splash guard for an outboard motor has been illustrated and described. Various modifications and or substitutions of the specific components described herein may be made without departing from the scope of the present invention. For example, splash guard 21 and splash guard 46 may be composed of various materials such as metal, or plastic, and the specific dimensions thereof may be varied depending upon the specific application and outboard motor to which it is applied.

Various modes of carrying out the invention are contemplated as being within the scope of the following claims particularly pointing out and distinctly claiming the subject matter regarded as the invention.

We claim:

1. In a marine drive having a propulsion assembly including an upper unit housing an engine, a lower unit including a gearcase carrying a propeller, said gearcase includes an anti-ventilation plate above said propeller and a spray plate spaced above said anti-ventilation plate, and a drive shaft housing mounted between the gearcase and upper unit and carrying a drive shaft for drivingly interconnecting the engine and propeller, and a transom bracket assembly positioned forwardly of said propulsion assembly for supporting the propulsion assembly from a transom of a boat, a splash guard for diverting water away from the propulsion and bracket assemblies during operation of the boat, comprising:

a substantially U-shaped deflector member mounted between said anti-ventilation plate and said spray plate, said deflector member having a head portion and a body portion extending rearwardly of said head portion, said head portion including a leading edge spaced forwardly of said gearcase and a trailing edge disposed adjacent said gearcase, and said body portion including a pair of rearwardly extending spaced apart fin members disposed on opposite sides of said gearcase each fin member having an inner edge disposed adjacent said gearcase and an outer edge spaced outwardly of said gearcase; and mounting means for removably mounting said deflector member on said gearcase.

2. The marine drive of claim 1 wherein said deflector member is substantially planar in shape.

3. The marine drive of claim 2 wherein said head portion and body portion are integral with one another.

4. The marine drive of claim 3 wherein each of said outer edges of said fin members is convexly curved in said plane of said deflector member and convexly curves all the way to the leading edge of said head portion without any straight sections therebetween and merging into said leading edge along a continuous unbroken curve of positive radius of curvature.

5. The marine drive of claim 1 wherein the leading edge of said head portion is arcuate-shaped.

6. The marine drive of claim 1 wherein at least a portion of the outer edge of one fin member is substantially parallel to the outer edge of the other fin member.

7. The marine drive of claim 1 wherein said mounting means includes at least one tab member extending inwardly from the inner edge of at least one of said fin members.

8. The marine drive of claim 7 wherein said mounting means further includes an opening extending through said tab member for receiving a securing member therethrough.

9. The marine drive of claim 8 wherein said securing member comprises a bolt member.

10. The marine drive of claim 9 wherein said mounting means further includes alignment means for aligning said head portion and body portion with respect to said gearcase.

11. The marine drive of claim 1 wherein the outer edges of said deflector member is spaced from said gearcase a distance greater than the outer edge of said anti-ventilation plate.

12. In a marine drive having a propulsion assembly including an upper unit housing an engine, a lower unit including a gearcase carrying a propeller and a drive shaft housing mounted between the gearcase and upper unit and carrying a drive shaft for drivingly interconnecting the engine and propeller, and a transom bracket assembly positioned forwardly of said propulsion assembly for supporting the propulsion assembly from a transom of a boat, a splash guard for diverting water away from the propulsion and bracket assemblies during operation of the boat, comprising;

a deflector member mounted between said gearcase and said drive shaft housing having a head portion and a body portion extending rearwardly of said head portion, said head portion including a leading edge spaced forwardly of said gearcase and a trailing edge disposed adjacent said gearcase, and said body portion including a pair of rearwardly extending spaced apart fin members disposed on opposite sides of said gearcase each fin member having an inner edge disposed adjacent said gearcase and an outer edge spaced outwardly of said gearcase, said deflector member is substantially planar in shape and said head portion and body portion are integral with one another, said defletor member further includes a tail portion integral with said body portion and extending rearwardly thereof; and mounting means for removably mounting said deflector member on said gearcase.

13. The marine drive of claim 12 wherein said deflector member includes a first opening formed therethrough through which said drive shaft extends and a second opening formed therethrough through which engine exhaust passes.

14. The marine drive of claim 13 wherein said deflector member further includes a cross member extending laterally of said body portion interconnecting the inner edges of said fin members and separating said first and second openings.

15. In a marine drive having a propulsion assembly including an upper unit housing an engine, a lower unit including a gearcase carrying a propeller, said gearcase includes an anti-ventilation plate above said propeller and a spray plate spaced above said anti-ventilation plate, and a drive shaft housing mounted between the gearcase and upper unit and carrying a drive shaft for drivingly interconnecting the engine and propeller, and a transom bracket assembly positioned forwardly of said proulsion assembly for supporting the propulsion assembly from a transom of a boat, a splash guard for diverting water away from the propulsion and bracket assemblies during operation of the boat, comprising:

a deflector member mounted between said anti-ventilation plate and said spray plate having a head portion and a body portion extending rearwardly of said head portion, said head portion including a leading edge spaced forwardly of said gearcase and a trailing edge disposed adjacent said gearcase, and said body portion including a pair of rearwardly extending spaced apart fin members disposed on opposite sides of said gearcase each fin member having an inner edge disposed adjacent said gearcase and an outer edge spaced outwardly of said gearcase, said deflector member is substantially planar in shape and said head portion and body portion are integral with one another, and each of said outer edges of said fin members is convexly curved in said plane of said deflector member and convexly curves all the way to the leading edge of said head portion without any straight sections therebetween and merging into said leading edge along a continuous unbroken curve of positive radius of curvature; and mounting means for removably mounting said deflector member on said gearcase.

16. The marine drive of claim 15 wherein the outer edges of said deflector member are spaced from said gearcase a distance greater than the outer edge of said anti-ventilation plate.

17. The marine drive of claim 15 wherein said deflector member further includes a tail portion integral with said body portion and extending rearwardly thereof.

18. The marine drive of claim 15 wherein said deflector member includes a first opening formed therethrough through which said drive shaft extends and a second opening formed therethrough through which engine exhaust passes.

19. The marine drive of claim 18 wherein said deflector member further includes a cross member extending laterally of said body portion interconnecting the inner edges of said fin members and separating said first and second openings.

* * * * *